US009781980B2

(12) United States Patent
Kheil et al.

(10) Patent No.: US 9,781,980 B2
(45) Date of Patent: Oct. 10, 2017

(54) RELEASABLE FASTENINGS WITH BARRIERS

(71) Applicant: Velcro BVBA, Deinze (BE)

(72) Inventors: Victor Horst Kheil, Kitchener (CA); Christopher M. Gallant, Nottingham, NH (US); Christopher C. Libby, Hooksett, NH (US)

(73) Assignee: Velcro BVBA (BE)

( * ) Notice: Subject to any disclaimer, the term of this patent is extended or adjusted under 35 U.S.C. 154(b) by 0 days.

(21) Appl. No.: 15/351,698

(22) Filed: Nov. 15, 2016

(65) Prior Publication Data

US 2017/0055644 A1 Mar. 2, 2017

Related U.S. Application Data

(60) Continuation of application No. 14/679,181, filed on Apr. 6, 2015, now Pat. No. 9,504,295, which is a (Continued)

(51) Int. Cl.
*A44B 18/00* (2006.01)
*B65D 33/25* (2006.01)

(52) U.S. Cl.
CPC ..... *A44B 18/0069* (2013.01); *A44B 18/0046* (2013.01); *A44B 18/0049* (2013.01); (Continued)

(58) Field of Classification Search
CPC ..... Y10T 24/2717; Y10T 24/2792; Y10T 24/45768; A44B 18/0046; A44B 18/0053; (Continued)

(56) References Cited

U.S. PATENT DOCUMENTS 3,282,493 A 11/1966 Seymour et al.
3,338,285 A 8/1967 Jaster et al.
(Continued)

FOREIGN PATENT DOCUMENTS

| | | |
|---|---|---|
| CN | 1422225 | 6/2003 |
| WO | 9832349 | 7/1998 |
| WO | 2008093168 | 8/2008 |

OTHER PUBLICATIONS

International Search Report for PCT/EP2013/060864 dated Oct. 22, 2013, 9 pages.

*Primary Examiner* — Abigail Troy
(74) *Attorney, Agent, or Firm* — Fish & Richardson P.C.

(57) ABSTRACT

A releasable fastening features a first fastening strip including an elongated, flexible base carrying an array of discrete fastener elements arranged in rows and columns, and a second fastening strip configured to releasably engage with the first fastening strip. The first fastening strip also includes a longitudinally continuous rib supported by the upper surface of the base of the first fastening strip, the rib extending sufficiently far from the base of the first fastening strip to engage a sealing portion of the second fastening strip, and of a bending strength sufficiently low that the rib is placed in an elastically bent state, when the first and second fastening strips are in the engaged state, thereby forming with the sealing portion of the second fastening strip a non-interlocking barrier to resist flow across the fastening with the first and second fastening strips in the engaged state.

15 Claims, 15 Drawing Sheets

Related U.S. Application Data division of application No. 13/800,642, filed on Mar. 13, 2013, now abandoned.

(60) Provisional application No. 61/653,717, filed on May 31, 2012.

(52) U.S. Cl.
CPC ..... *A44B 18/0053* (2013.01); *A44B 18/0084* (2013.01); *B65D 33/2541* (2013.01); *Y10T 24/2717* (2015.01); *Y10T 24/2792* (2015.01); *Y10T 24/45168* (2015.01)

(58) Field of Classification Search
CPC ..... A44B 18/0049; A44B 18/0057; A44B 18/0061; A44B 18/0069; A44B 18/0088; A44B 18/0096; B65D 33/2508; B65D 33/2541; B65D 33/2558
See application file for complete search history.

(56) References Cited

U.S. PATENT DOCUMENTS

| | | | |
|---|---|---|---|
| 3,403,429 | A | 10/1968 | Henry |
| 3,445,420 | A | 5/1969 | Rinecker |
| 3,464,094 | A | 9/1969 | Mates |
| 3,565,147 | A | 2/1971 | Ausnit |
| 3,655,118 | A | 4/1972 | Rinecker |
| 3,827,472 | A | 8/1974 | Uramoto |
| 4,201,741 | A | 5/1980 | Pannenbecker |
| 4,337,889 | A | 7/1982 | Moertel |
| 4,426,816 | A | 1/1984 | Dean et al. |
| 4,578,813 | A | 3/1986 | Ausnit |
| 4,601,694 | A | 7/1986 | Ausnit |
| 4,617,683 | A | 10/1986 | Christoff |
| 4,637,063 | A | 1/1987 | Sullivan et al. |
| 4,658,433 | A | 4/1987 | Savicki |
| 4,665,552 | A | 5/1987 | Lems |
| 4,699,580 | A | 10/1987 | Co |
| 4,796,300 | A | 1/1989 | Branson |
| 5,009,828 | A | 4/1991 | McCree |
| 5,345,659 | A | 9/1994 | Allan |
| 5,470,156 | A | 11/1995 | May |
| 5,474,382 | A | 12/1995 | May |
| 5,489,252 | A | 2/1996 | May |
| 5,509,735 | A | 4/1996 | May |
| 5,542,766 | A | 8/1996 | Cadwallader |
| 5,551,127 | A | 9/1996 | May |
| 5,605,594 | A | 2/1997 | May |
| 5,647,671 | A | 7/1997 | May |
| 5,725,312 | A | 3/1998 | May |
| 5,729,876 | A | 3/1998 | Johnson |
| 5,816,709 | A | 10/1998 | Demus |
| 5,887,980 | A | 3/1999 | May |
| 5,893,645 | A | 4/1999 | May |
| 5,904,425 | A | 5/1999 | May |
| 6,163,939 | A | 12/2000 | Lacey et al. |
| 6,209,177 | B1 | 4/2001 | Murasaki |
| 6,582,642 | B1 | 6/2003 | Buzzell et al. |
| 6,851,161 | B2 | 2/2005 | Kingsford et al. |
| 6,896,759 | B2 | 5/2005 | Fujisawa et al. |
| 6,991,375 | B2 | 1/2006 | Clune et al. |
| 7,022,394 | B2 | 4/2006 | Fujisawa et al. |
| 7,141,283 | B2 | 11/2006 | Janzen et al. |
| 7,270,479 | B2 | 9/2007 | Nelson |
| 7,340,807 | B2 | 3/2008 | Dais et al. |
| 9,504,295 | B2 | 11/2016 | Kheil et al. |
| 2005/0263936 | A1 | 12/2005 | Bosse |
| 2006/0255497 | A1 | 11/2006 | Prevotat |
| 2007/0297698 | A1 | 12/2007 | Berich |
| 2009/0010735 | A1 | 1/2009 | Gallant et al. |
| 2009/0100648 | A1 | 4/2009 | Naftalin et al. |
| 2009/0100651 | A1 | 4/2009 | Naftalin et al. |
| 2010/0014786 | A1 | 1/2010 | Pawloski |
| 2011/0097018 | A1 | 4/2011 | Turvey |
| 2011/0167598 | A1 | 7/2011 | Cheng |
| 2011/0171430 | A1 | 7/2011 | Mayers et al. |
| 2013/0318752 | A1 | 12/2013 | Kheil et al. |
| 2015/0208770 | A1 | 7/2015 | Kheil et al. |

RELEASABLE FASTENINGS WITH BARRIERS

This is a continuation of U.S. Ser. No. 14/679,181, filed on Apr. 6, 2015, which is a divisional of U.S. Ser. No. 13/800,642, filed on Mar. 13, 2013, entitled Releasable Fastenings with Barriers. This application claims the benefit of U.S. Provisional Application No. 61/653,717, filed on May 31, 2012. The disclosures of these prior applications are hereby incorporated by reference in their entireties and are therefore considered part of the disclosure of this application.

TECHNICAL FIELD

This invention relates to releasable fastenings with barriers, such as for bag closures that inhibit flow across the closure.

BACKGROUND

Extruded interlocking profile fasteners, such as those known to be marketed under the trade name "ZIPLOC", have been employed as closures for bags and other packaging for many years. Such closures have the advantage of providing a reasonably reliable seal across the bag opening, as well as holding the two sides of the bag opening together. Furthermore, they are readily produced by known extrusion methods, their principle of engagement being the interlocking of mating longitudinal features having extrudable, complementary shapes. Thus, such a fastening is sometimes referred to as 'rib and groove' fastening. Forming the head of the rib to be wider than the neck of the groove creates a 'snap' engagement (during which one or both of the profiles resiliently deforms) to retain the rib within the groove until pulled out. A relatively tight fit of the rib within its groove can provide an effective seal. Rib and groove closure strips and the film forming the sides of their associated bags are commonly made separately and then joined.

Recently, advancements in the production and design of both hook-and-loop and hook-to-hook fastenings have resulted in cost effective alternatives to rib and groove fastening for releasably securing bag openings in a closed condition. These types of fastenings do not require precise alignment for closure. However, both of the hook-and-loop and hook-to-hook closures form many small passages between the engaged fastener elements, enabling air (and, in some cases, liquids) to migrate across the closure. For some applications, such free ventilation is desirable. In some other applications, however, a liquid or air-tight seal, or an advantageously lower leak rate, would be preferred.

SUMMARY

One aspect of the invention features a first fastening strip including an elongated, flexible base carrying an array of discrete fastener elements arranged in rows and columns, the array extending across a portion of a width of the base, each of the fastener elements having a resin stem extending from an upper surface of the base, and a lip disposed at a distal end of the stem and overhanging the base; the upper surface of the base and the stems of the fastener elements together forming a contiguous mass of resin; and a second fastening strip configured to releasably engage with the first fastening strip, the second fastening strip including a flexible base with a field of fastener elements carried on a fastening side thereof, the field of fastener elements arranged to overlap with the array of discrete fastener elements of the first fastening strip, such that when the first and second fastening strips are brought into engagement the overhanging lips of the discrete fastener elements of the first fastening strip cooperate with the fastener elements of the second fastening strip to releasably hold the first and second fastening strips in an engaged state. The first fastening strip also includes a longitudinally continuous rib supported by the upper surface of the base of the first fastening strip, the rib extending sufficiently far from the base of the first fastening strip to engage a sealing portion of the second fastening strip, and of a bending strength sufficiently low that the rib is placed in an elastically bent state, when the first and second fastening strips are in the engaged state, thereby forming with the sealing portion of the second fastening strip a non-interlocking barrier to resist flow across the fastening with the first and second fastening strips in the engaged state.

In some examples, the lip of each of the fastener elements of the first fastening strip overhangs the base in a longitudinal direction of the base.

In some implementations, at least a portion of the rib forms a part of the contiguous mass of resin.

In some applications, the field of fastener elements of the second fastening strip includes an array of discrete fastener elements configured to interlock with the fastener elements of the first fastening strip.

In some embodiments, the rib is disposed between two portions of the array of discrete fastener elements of the first fastening strip.

In some examples, the rib is positioned outboard of the array of discrete fastener elements of the first fastening strip.

In some cases, the second fastening strip has a rib stop extending from the fastening side of the base of the second fastening strip and positioned to engage a portion of the rib with the rib in its elastically bent state. In some applications, the rib stop includes a column of discrete fastener elements. In some embodiments, the rib stop includes a substantially straight, upstanding spine.

In some implementations, the rib has a height, as measured from the upper surface of the base of the first fastening strip, that is between about 0.8 and 3 times an overall width of the rib, excluding any fillets. In some cases, the rib has a height, as measured from the upper surface of the base of the first fastening strip, that is at least 5 times an overall width of the rib, excluding any fillets.

In some examples, the rib includes a substantially straight, upstanding spine terminating in a slender distal tip. In some applications, the spine has a height, as measured from the upper surface of the base of the first fastening strip, that is greater than that of the fastener elements. In some applications, the bending strength of the rib is sufficiently low to allow the rib to at least partially buckle when the first and second fastening strips are in the engaged state.

In some embodiments, the rib extends directly from the upper surface of the base of the first fastening strip to a distal rib edge that overhangs the upper surface of the base of the first fastening strip in a relaxed state. The distal rib edge can overhang the upper surface of the base of the first fastening strip in a lateral direction of the base.

In some applications, the sealing portion of the second fastening strip includes a pedestal structure positioned on the fastening side of the base of the second fastening strip.

In some cases, the sealing portion of the second fastening strip includes the base of the second fastening strip.

In some examples, the first fastening strip further includes a pedestal structure extending directly from the upper surface of the base of the first fastening strip, and the rib extends directly from the pedestal structure.

In some implementations, the rib is a first rib, and the sealing portion of the second fastening strip includes a second longitudinal rib positioned on the fastening side of the base of the second fastening strip. The height of the first rib can be less than a height of the fastening elements.

In some embodiments, the rib includes a wedge-shaped structure defining a relatively thick base section continuously tapering to a relatively narrow convex peak. In some applications, the rib is a first rib, and the sealing portion of the second fastening strip includes at least two second ribs defining a trough therebetween, the second ribs positioned on the fastening side of the base of the second fastening strip such that the first rib is received by the trough when the fastening strips are in the engaged state. The second ribs can be wider than the first rib.

Another aspect of the invention features a first fastening strip including an elongated, flexible base carrying an array of discrete fastener elements arranged in rows and columns, the array extending across a portion of a width of the base, each of the fastener elements having a resin stem extending from an upper surface of the base, and a lip disposed at a distal end of the stem and overhanging the base; the upper surface of the base and the stems of the fastener elements together forming a contiguous mass of resin; and a second fastening strip configured to releasably engage with the first fastening strip, the second fastening strip including a flexible base with an array of discrete fastener elements carried on a fastening side thereof, the field of fastener elements configured to interlock with the fastener elements of the first fastening strip to releasably hold the first and second fastening strips in an engaged state. The first fastening strip also includes a longitudinally continuous rib that extends from the upper surface of the base of the first fastening strip to a longitudinally continuous peak. The second fastening strip has a longitudinally continuous, convex surface region arranged to engage the peak of the rib of the first fastening strip in the engaged state, such that tension between the fastener elements of the first and second fastening strips balances a compressive force between the peak and convex surface region in the engaged state, thereby forming a non-interlocking barrier to resist flow across the fastening with the first and second fastening strips in the engaged state.

In some examples, the first fastening strip includes two parallel ribs with respective peaks separated by a distance less than a width of the convex surface region.

In some implementations, the convex surface region is of a compressible material carried on the upper surface of the fastening side of the base of the second fastening strip.

Yet another aspect of the invention features a first fastening strip including an elongated, flexible base carrying an array of discrete fastener elements arranged in rows and columns, the array extending across a portion of a width of the base, each of the fastener elements having a resin stem extending from an upper surface of the base, and a lip disposed at a distal end of the stem and overhanging the base; the upper surface of the base and the stems of the fastener elements together forming a contiguous mass of resin; and a second fastening strip configured to releasably engage with the first fastening strip, the second fastening strip including a flexible base with a field of fastener elements carried on a fastening side thereof, the field of fastener elements arranged to overlap with the array of discrete fastener elements of the first fastening strip, such that when the first and second fastening strips are brought into engagement the overhanging lips of the discrete fastener elements of the first fastening strip cooperate with the fastener elements of the second fastening strip to releasably hold the first and second fastening strips in an engaged state. The first fastening strip also includes a longitudinally continuous rib that extends from the upper surface of the base of the first fastening strip to a distal peak, the rib extending sufficiently far from the base of the first fastening strip to engage the base of the second fastening strip when the first and second fastening strips are in the engaged state, thereby forming with the base of the second fastening strip a barrier to resist flow across the fastening with the first and second fastening strips in the engaged state. The rib undulates in widthwise position on the upper surface of the first fastening strip base, along the first fastening strip, with some sections of the peak disposed closer to one lateral edge of the first fastening strip than other sections of the peak.

In some examples, the field of fastener elements of the second fastening strip includes an array of discrete fastener elements configured to interlock with the fastener elements of the first fastening strip.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Referring first to FIGS. 1A-1D, an example releasable fastening 100 includes two longitudinally continuous fastening strips 102*a* and 102*b*. Each of fastening strips 102*a* and 102*b* includes an elongated flexible base 104*a*, 104*b* carrying an array of discrete fastener elements 106*a*, 106*b* on an upper fastening surface 105*a*, 105*b*. The arrays of fastener elements are arranged in rows and columns that spread across a widthwise portion of the fastening surface of each fastening strip. Adjacent rows of fastener elements are separated by fastener element-free lanes such that one could look across the strip in a lateral direction (e.g., a cross-machine direction) and see open space between laterally adjacent fastener elements.

Figure 1A:
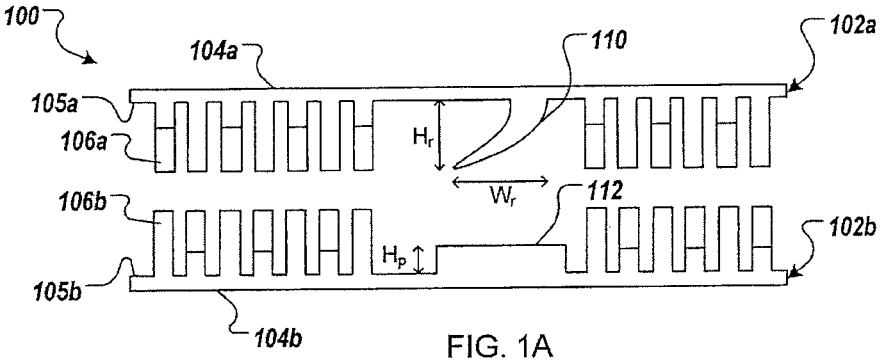
FIGS. 1A and 1B are sequential cross-sectional views of a first releasable fastening that illustrate engagement of mating fastening strips.
Figure 1B:
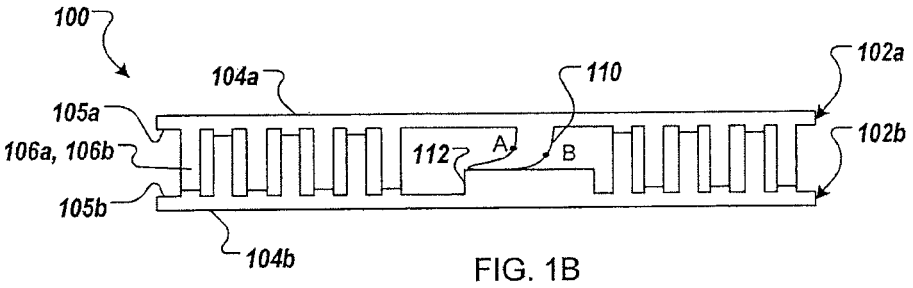
Figure 1C:
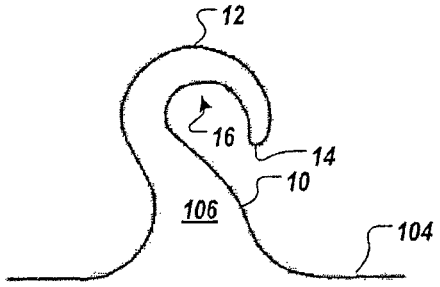
FIG. 1C is a side view of an example fastener element.

As shown in FIG. 1C, one particularly useful type of fastener element 106 (referring to either of fastener elements 106*a* or 106*b*) includes a molded stem 10, which extends outward from a flexible base 104 (referring to either of flexible base 104*a* or 104*b*) and continuously tapers in width, and a curved head 12 crowning the stem. The head of the fastener element overhangs the base in a longitudinal direction (e.g., a machine direction) terminating in a distal reentrant tip 14 and defining a crook 16. In this example, the fastener element and the supporting flexible base together form a unitary and seamless mass of resin, with the fastener element extending contiguously and integrally from the upper fastening surface of the base.

Figure 1D:
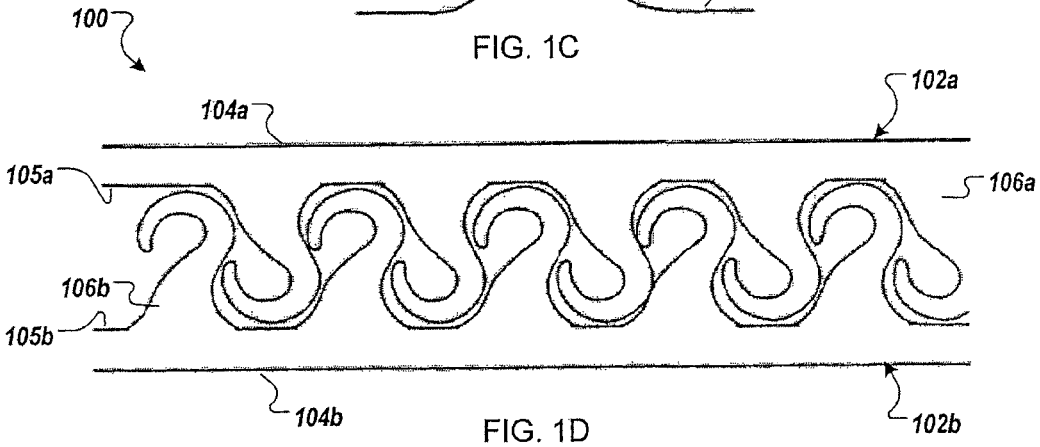
FIG. 1D is a side view of the first releasable fastening illustrating the fastening strips in an engaged state.

Fastening strips 102*a* and 102*b* are configured to releasably engage with one another. More specifically, fastener elements 106*a* are arranged to overlap with fastener elements 106*b* to form an interlocking engagement between fastening strips 102*a* and 102*b*. As shown in FIG. 1D, when fastening strips 102*a* and 102*b* are brought into engagement with one another, each row of fastener elements 106*a* is forced between an adjacent row of fastener elements 106*b*. In other words, the fastener element-free lanes of one strip are appropriately configured (e.g., sized, shaped, and arranged) to receive the rows of fastener elements of the other strip, and vice versa. The engaged fastener elements cooperate to hold the fastening strips together in an engaged state, as shown in FIG. 1B. These and other types of appropriate hook-to-hook, self-engaging fastening closures are described in U.S. Patent Publication 2009/0010735, the entirety of which is hereby incorporated by reference. Additionally, as discussed in detail below, engagement of the fastening strips imparts an appropriate sealing force on mating components of a flow barrier that seals the releasable fastening against fluid flow in the lateral direction.

In this example, fastening strip 102*a* includes a longitudinally continuous rib 110 positioned between two portions of the array of fastener elements 106*a*. Rib 110 is provided in the form of a broad trunk that extends integrally from fastening surface 105*a*. The trunk progressively curves in the lateral direction while tapering in thickness to form a sealing lip. The lip terminates in a narrow distal tip that overhangs the fastening surface. As shown, rib 110 extends to define an overall height $H_r$ and an overall width $W_r$. In some examples, the height $H_r$ is between about 0.8 and 3 (e.g., about 1.3) times the overall width $W_r$. The bending strength of the rib is sufficiently low to place the rib in an elastically bent state against a portion of the other fastening strip when the strips are held together in the engaged state. By "elastically bent state" we mean that the rib is in a reversible state in which a point A on one side of the rib is in compression while a corresponding point B on an opposite side of the rib is in tension. Providing the rib with a sufficiently low bending strength can be accomplished through any conventional static engineering techniques (e.g., material selection, geometric dimensioning, etc.).

As shown, fastening strip 102*b* includes a longitudinally continuous pedestal 112 extending integrally from fastening surface 105*b* to a height $H_p$. Pedestal 112 defines a substantially flat sealing face for engaging the sealing lip of rib 110. The pedestal is formed on the fastening surface between to portions of the array of fastener elements so as to align with the rib when the fastening strips are brought together for engagement. The height of the rib and the pedestal are such that, when the fastening strips are in the engaged state, a backside surface of the rib's sealing lip is forced against the sealing face of the pedestal to provide a sealed engagement. Thus, the rib and the pedestal cooperate to form a non-interlocking barrier to resist fluid flow in the lateral direction. By "non-interlocking" we mean that no portion of either strip overlaps any portion of the other strip in a lateral cross-section at the barrier.

Figure 1E:
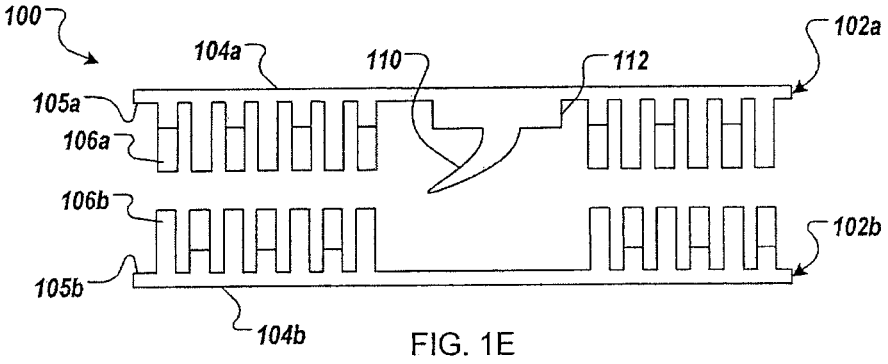
FIG. 1E is a side view of an alternate embodiment of the first releasable fastening.

FIG. 1E shows an alternate embodiment of fastening 100 where both rib 110 and pedestal 112 are formed on fastening strip 102*a*. In this example, the pedestal extends integrally from the fastening face of the upper strip, and the rib extends integrally from the pedestal. Fastening strip 102*b* provides an open area between two portions of the array of fastener elements 106*b* to receive rib 110 and pedestal 112. The overall height of the rib-pedestal structure is such that, when the fastening strips are held in an engaged state, the backside surface of the rib's sealing lip is forced against the fastening face in the open area on the lower strip to provide a sealed engagement. This arrangement can provide additional support to the flexible base on the rib side of the fastening.

Figure 2A:
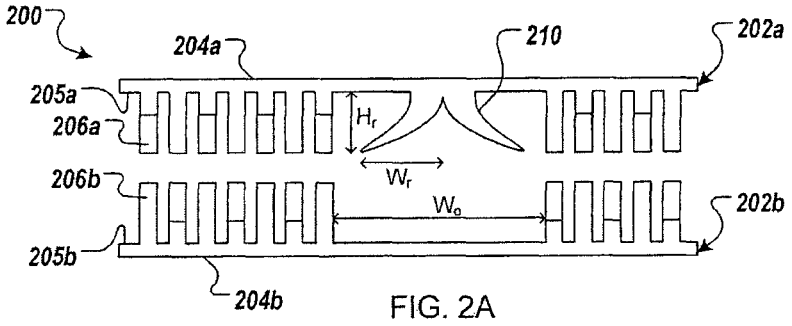
FIGS. 2A and 2B are sequential cross-sectional views of a second releasable fastening that illustrate engagement of mating fastening strips.
Figure 2B:
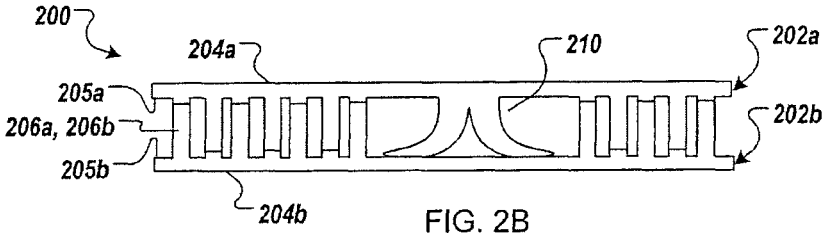

Turning now to FIGS. 2A and 2B, another releasable fastening 200 is shown which is similar to fastening 100. For example, fastening 200 includes two longitudinally continuous fastening strips 202*a* and 202*b* that are intended to releasably engage with one another in a hook-to-hook engagement. Each of fastening strips 202*a* and 202*b* includes an elongated flexible base 204*a*, 204*b* carrying an array of discrete fastener elements 206*a*, 206*b* on a fastening surface 205*a*, 205*b*.

In this example, fastening strip 202*a* includes two continuous longitudinal ribs 210 positioned between portions of the array of fastener elements 206*a*. Ribs 210 are similar in structure to rib 110. As shown, the lips of ribs 210 curve laterally outward from their trunks in opposite directions to overhang respective portions of fastening surface 205*a*. Fastening strip 202*b* provides an open area between respective portions of the array of fastener elements 206*b*. The open area defines a lateral width $W_o$. Together, the open area of the fastening surface and the rows of fastener elements bordering the area on either side define a channel to receive ribs 210. The ribs are formed on the fastening surface so as to align with the channel on the other fastening strip when the two strips are brought together for engagement.

Each of the ribs extends to an overall height $H_r$, which is greater than the height of the fastener elements, and a width $W_r$. In some examples, the height $H_r$ is between about 0.8 and 3 (e.g., about 1.6) times the overall width $W_r$. As shown, engagement of the fastening strips forces a backside portion of each rib's sealing lip to press against the fastening surface of the other fastening strip, thereby placing the ribs in an elastically bent state and effecting a seal against fluid flow in the lateral direction. Accordingly, the ribs cooperate with the channel provided by the lower fastening strip to form a non-interlocking barrier to resist fluid flow. Although not shown here, in some examples, elastic bending of the ribs can cause their distal tips to encounter and rest against the bordering rows of fastener elements on either side of the open area. The bordering fastener elements form a "rib stop" to support the ribs against excessive buckling.

Figure 2C:
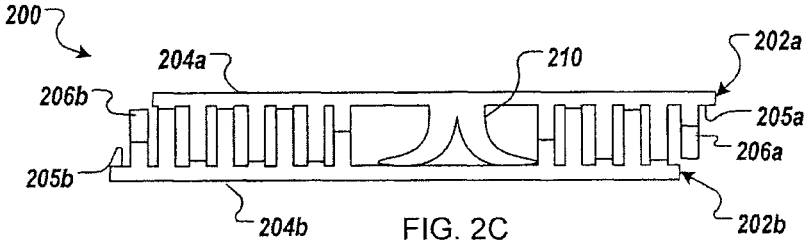
FIG. 2C is a cross-sectional view of the second releasable fastening illustrating misalignment of the mating fastening strips.

In some examples, the width $W_o$ of the open area is sufficient to allow the fastening strips to be at least partially misaligned without adversely affecting the seal provided at the barrier. For example, as shown in FIG. 2C, the fastening strips may be misaligned by at least one column of fastener elements without inhibiting the sealing ability of the barrier.

Figure 3A:
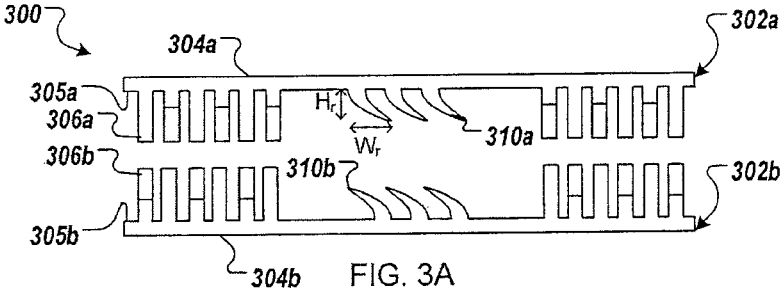
FIGS. 3A and 3B are sequential cross-sectional views of a third releasable fastening that illustrate engagement of mating fastening strips.
Figure 3B:
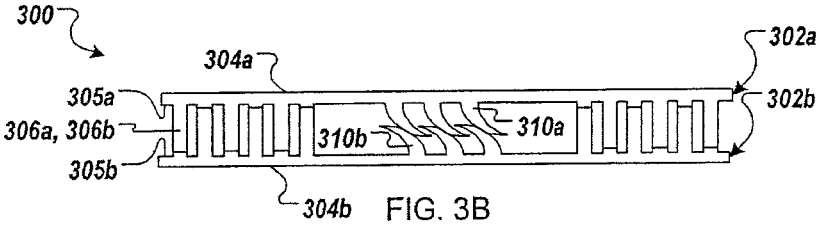

Turning now to FIGS. 3A and 3B, another releasable fastening 300 is shown which is similar to fastening 200. For example, fastening 300 includes two longitudinally continuous fastening strips 302*a* and 302*b* that are intended to releasably engage with one another in a hook-to-hook engagement. Each of fastening strips 302*a* and 302*b* includes an elongated flexible base 304*a*, 304*b* carrying an array of discrete fastener elements 306*a*, 306*b* on a fastening surface 305*a*, 305*b*.

In this example, each of fastening strips 302*a* and 302*b* includes a respective set of continuous longitudinal ribs 310*a*, 310*b* positioned between portions of the arrays of fastener elements 306*a*, 306*b*. Ribs 310*a*, 310*b* may be similar in structure to ribs 210 shown in FIGS. 2A and 2B. Each of the ribs extends from the fastening surface to an overall height $H_r$ that is less than the height neighboring fastener elements. For example, the height of the ribs may be about one-half of the fastener element height. Further, in some examples, the height $H_r$ is between about 0.8 and 3 (e.g., about 1) times an overall width $W_r$. Ribs 310*a*, 310*b* are positioned on their respective fastening surfaces 305*a*, 305*b* such that when the strips are aligned for engagement the ribs of one strip are positioned over the ribs of the other strip. When the fastening strips are in the engaged state, the ribs of one strip press against the corresponding ribs of the other strip with sufficient force to place the engaged ribs in an elastically bent state. The interface between the ribs provides a seal against fluid flow in the lateral direction. Together, ribs 310*a* and 310*b* form a non-interlocking barrier to resist fluid flow.

Figure 3C:
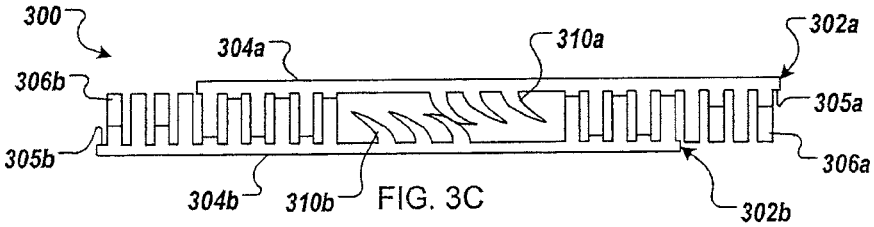
FIG. 3C is a cross-sectional view of the third releasable fastening illustrating misalignment of the mating fastening strips.

FIG. 3B shows a particular example where fastening strips 302*a* and 302*b* are aligned such that each of the ribs 310*a* is matched with a respective rib 310*b*, providing multiple sealing interfaces between the ribs. In some examples, however, a suitable seal can be formed by the interface between a single pair of ribs 310*a*, 310*b*. As a result, the fastening strips can be misaligned to some degree (e.g., by two or more columns of fastener elements) while still provided an effective seal at the barrier. FIG. 3C shows an example, where the fastening strips are somewhat misaligned such that just a single sealing interface is provided by the ribs.

Figure 4A:
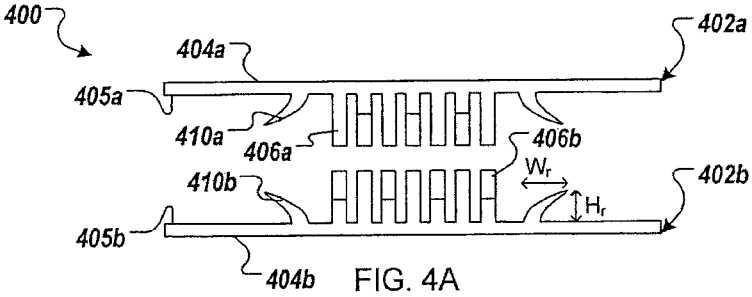
FIGS. 4A and 4B are sequential cross-sectional views of a fourth releasable fastening that illustrate engagement of mating fastening strips.
Figure 4B:
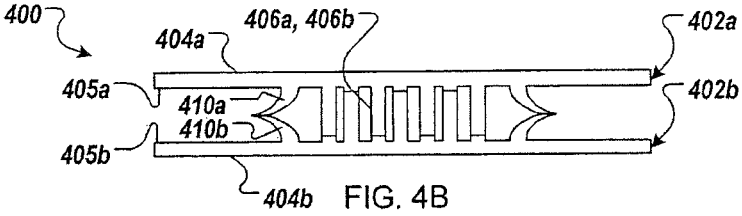

Turning now to FIGS. 4A and 4B, another releasable fastening 400 is shown. Similar to the examples described above, fastening 400 includes two longitudinally continuous fastening strips 402*a* and 402*b* that are intended to releasably engage with one another in a hook-to-hook engagement. Each of fastening strips 402*a* and 402*b* includes an elongated flexible base 404*a*, 404*b* carrying an array of discrete fastener elements 406*a*, 406*b* on a fastening surface 405*a*, 405*b*.

In this example, each of fastening strips 402*a* and 402*b* includes a pair of continuous longitudinal ribs 410*a*, 410*b*. Ribs 410*a*, 410*b* may be similar in structure to ribs 310*a*, 310*b* shown in FIGS. 3A and 3B. On each strip, a respective rib of the pair is positioned on one lateral side of the array of fastener elements and extends laterally outward, away from the fastener elements. Thus, as shown, the ribs bracket the fastener element arrays. Each of the ribs extends from the fastening surface to an overall height $H_r$ that is less than the height fastener elements. In some examples, the height $H_r$ is between about 0.8 and 3 (e.g., about 1) times an overall width $W_r$. When the fastening strips are aligned for engagement, the ribs of one strip are positioned over the ribs of the other strip such that when the fastening strips are forced into the engaged state, the ribs of one strip are pressed against the ribs of the other strip. Engagement of the ribs places them in an elastically bent state against one another to effect a seal against fluid flow in the lateral direction. Accordingly, ribs 410*a* and 410*b* cooperate to form a non-interlocking barrier to resist fluid flow.

Figure 5A:
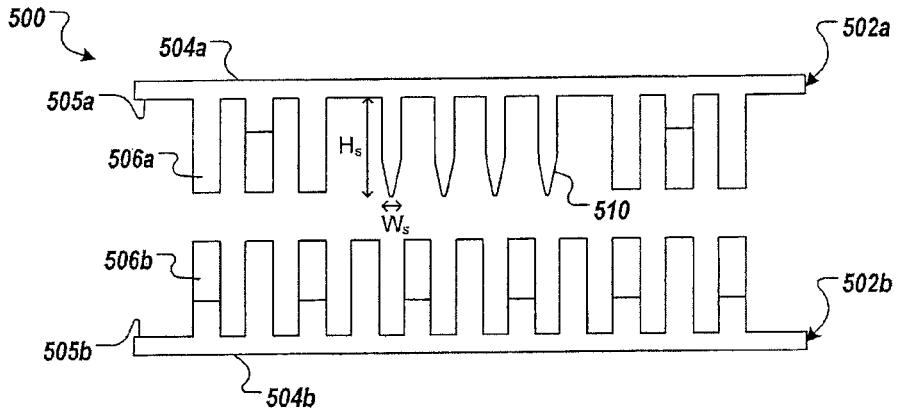
FIGS. 5A-5C are sequential cross-sectional views of a fifth releasable fastening that illustrate engagement of mating fastening strips.
Figure 5B:
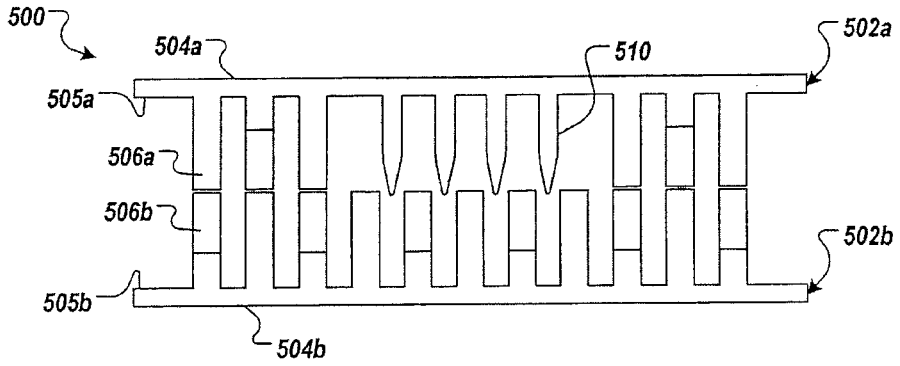
Figure 5C:
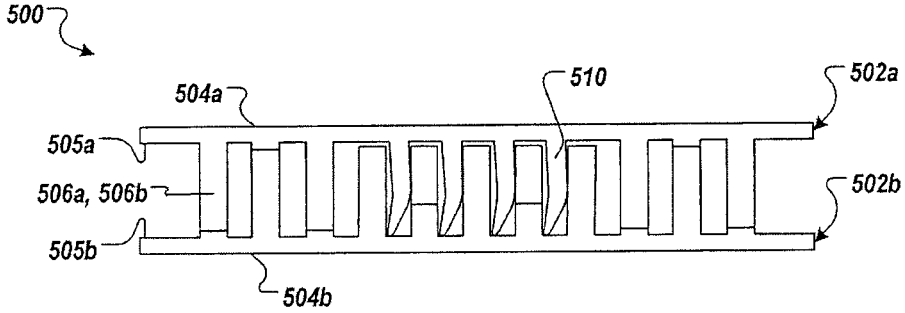

FIGS. 5A-5C illustrate another releasable fastening 500. Similar to some previous examples, fastening 500 includes two longitudinally continuous fastening strips 502*a* and 502*b* that are intended to releasably engage with one another in a hook-to-hook engagement. Each of fastening strips 502*a* and 502*b* includes an elongated flexible base 504*a*, 504*b* carrying an array of discrete fastener elements 506*a*, 506*b* on a fastening surface 505*a*, 505*b*.

In this example, fastening strip 502*a* includes a set of continuous longitudinal spines 510 positioned between respective portions of the array of fastener elements 506*a*. Spines 510 are upstanding rib-type structures that extend integrally from fastening surface 505*a* to a height $H_s$, which is slightly greater than that of the neighboring fastener elements, and a width $W_s$. In some examples, the height $H_s$ is at least five (e.g., about eight) times an overall width $W_s$. Spines 510 are formed on fastening surface 505*a* so as to align with the space between adjacent columns of fastener elements 506*b*. As shown in FIG. 5B, when fastening strips 502*a* and 502*b* are brought together for engagement, spines 510 partially mesh with the fastener elements of the opposing strip (that is, the spines penetrate the area between the columns of fastener elements) before there is any engagement between fastener elements 506*a* and 506*b*. Accordingly, the spines can be used to facilitate proper alignment of the fastening strips prior to engagement. When the fastening strips are held in the engaged state (see FIG. 5C), the spines are forced into an elastically bent state against the base of the other fastening strip, effecting a seal to resist fluid flow. The spines are supported against buckling by the bordering columns of fastener elements on either lateral side, which provide a rib stop. As shown, the width $W_s$ of the spines is such that there is a relatively tight fit between the columns of fastener elements. Together, the spines and the engaged portions of the other fastening strip (i.e., the fastener elements and the flexible base) form a non-interlocking barrier to resist fluid flow.

Figure 6A:
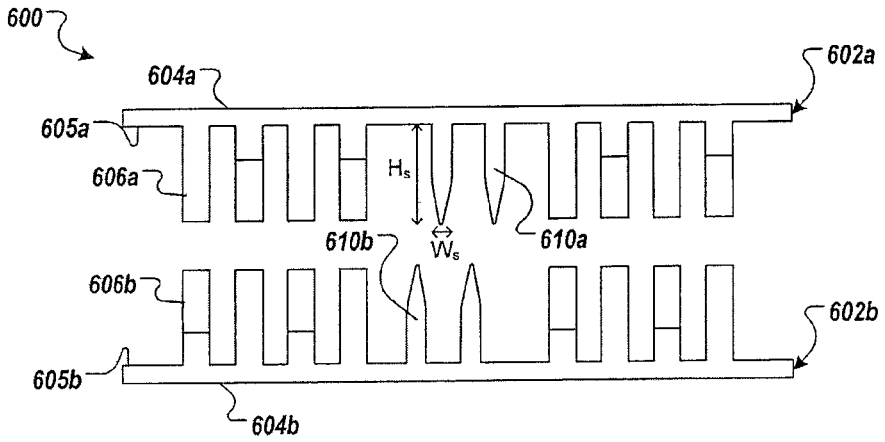
FIGS. 6A-6C are sequential cross-sectional views of a sixth releasable fastening that illustrate engagement of mating fastening strips.
Figure 6B:
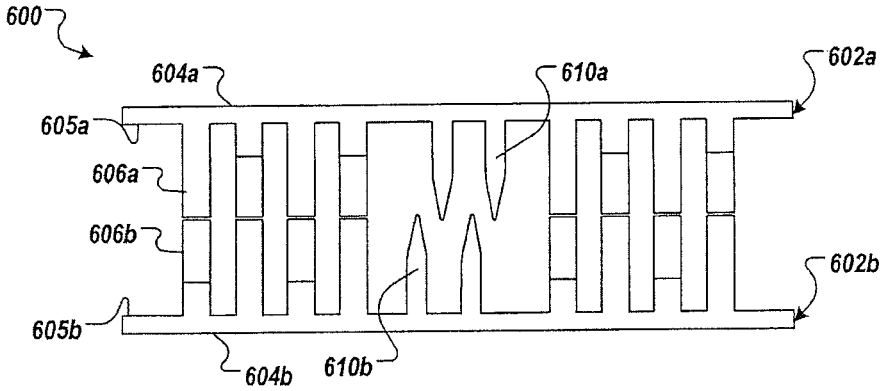
Figure 6C:
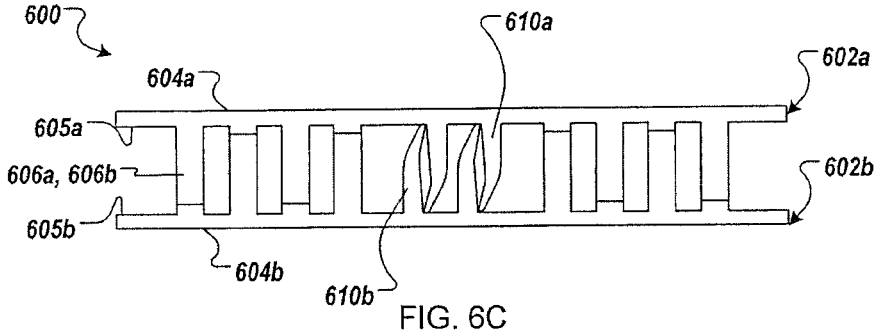

Turning now to FIGS. 6A-6C, another releasable fastening 600 is shown which is similar to fastening 500. For example, fastening 600 includes two longitudinally continuous fastening strips 602*a* and 602*b* that are intended to releasably engage with one another in a hook-to-hook engagement. Each of fastening strips 602*a* and 602*b* includes an elongated flexible base 604*a*, 604*b* carrying an array of discrete fastener elements 606*a*, 606*b* on a fastening surface 605*a*, 605*b*.

In this example, each of the fastening strips 602*a* and 602*b* includes a respective set of continuous longitudinal spines 610*a*, 610*b* positioned between portions of the arrays of fastener elements 606*a*, 606*b*. Similar to spines 510 from the previous example, spines 610*a*, 610*b* are upstanding rib-type structures that extend integrally from fastening surface 605*a* to a height $H_s$, which is slightly greater than that of the neighboring fastener elements, and a width $W_s$. In some examples, the height $H_s$ is at least five times an overall width $W_s$. The spines on each strip are formed on the fastening surface so as to align with the spines on the opposing strip. As shown in FIG. 6B, when fastening strips 602*a* and 602*b* are brought together for engagement, spines 610*a* partially mesh with the spines 610*b* before there is any engagement between fastener elements 606*a* and 606*b*. Accordingly, the spines can be used to facilitate proper alignment of the fastening strips prior to engagement. When the fastening strips are held in the engaged state (see FIG. 6C), the spines are forced into an elastically bent state against the base of the other fastening strip, effecting a seal to resist fluid flow. Thus, the spines of the respective fastening strip cooperate to form a non-interlocking barrier to resist fluid flow. The spines can also cooperate to form rib stops, supporting one another against buckling. For example, as shown in FIG. 6C, elastic bending of the ribs can cause their distal tips to encounter and rest against the base of a neighboring rib.

Figure 7A:
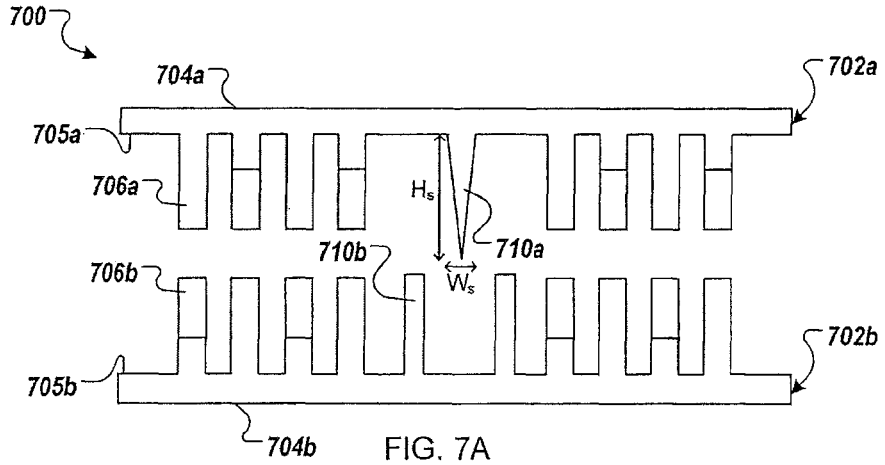
FIGS. 7A and 7B are sequential cross-sectional views of a seventh releasable fastening that illustrate engagement of mating fastening strips.
Figure 7B:
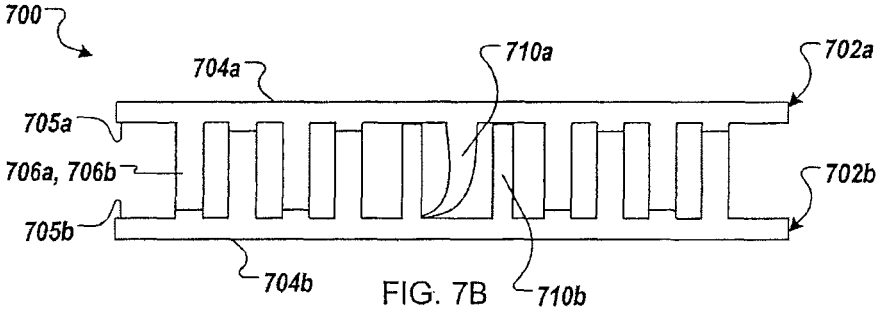

FIGS. 7A and 7B show yet another releasable fastening 700 that is similar to some of the previous examples. For example, fastening 700 includes two longitudinally continuous fastening strips 702*a* and 702*b* that are intended to releasably engage with one another in a hook-to-hook engagement. Each of fastening strips 702*a* and 702*b* includes an elongated flexible base 704*a*, 704*b* carrying an array of discrete fastener elements 706*a*, 706*b* on a fastening surface 705*a*, 705*b*.

In this example, fastening strip 702*a* includes a particularly thin wedge-shaped spine 710*a* that is continuous in the longitudinal direction. The spine is positioned on the fastening surface of the strip between respective portions of the array of fastener elements. Spine 710*a* extends integrally from fastening surface 705*a* to define an overall height $H_s$ and a width $W_s$. The height $H_s$ is greater than that of the neighboring fastener elements. Further, in some examples, the height $H_s$ is at least five (e.g., about eight) times an overall width $W_s$. Fastening strip 702*b* includes two upstanding ribs 710*b* that are formed on fastening surface 705*b* so as to align with spine 710*a*. In particular, ribs 710*b* are positioned so as to receive spine 710*a* in a channel formed between the ribs. As shown in FIG. 7B, when fastening strips 702*a* and 702*b* are held into the engaged state, spine 710*a* is forced into an elastically bent state against fastening surface 705*b*, effecting a seal against fluid flow in the lateral direction. The slenderness of the spine in conjunction with the wide space between the upstanding ribs allows the spine to buckle under the force of engagement between the fastening strips. As shown, the buckling causes the distal tip of the spine to bow outward in the lateral direction. The deflected tip of the spine may encounter and rest against the adjacent upstanding ribs, which act as a rib stop to support the spine against further buckling. Thus, the spines and ribs cooperate to form a non-interlocking barrier to resist fluid flow.

Figure 8A:
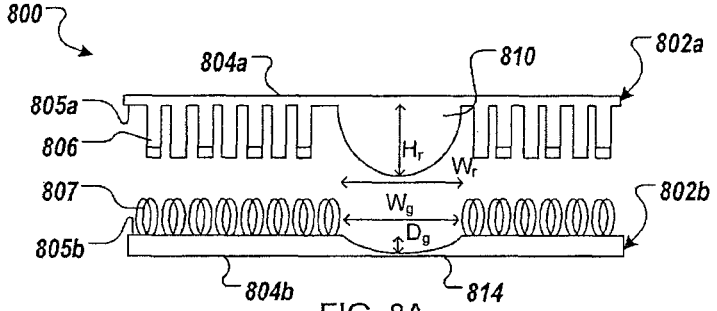
FIGS. 8A and 8B are sequential cross-sectional views of an eight releasable fastening that illustrate engagement of mating fastening strips.
Figure 8B:
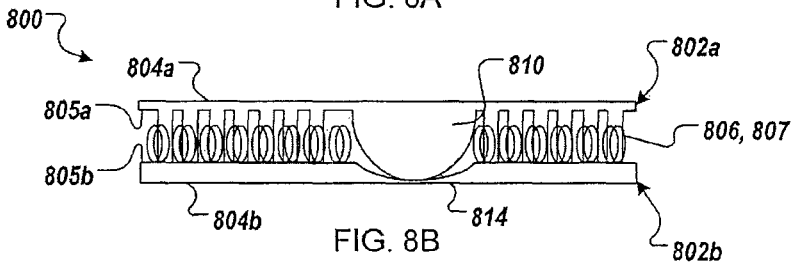

FIGS. 8A and 8B illustrate another releasable fastening 800. Similar to some of the previous examples, fastening 800 includes two longitudinally continuous fastening strips 802*a* and 802*b* that are intended to releasably engage with one another. Each of fastening strips 802*a* and 802*b* includes an elongated flexible base 804*a*, 804*b* having a fastening surface 805*a*, 805*b* carrying respective elements of a hook-and-loop fastening. For example, fastening surface 805*a* carries an array of discrete hook elements 806, and fastening surface 805*b* carries a patch of loop material 807 configured to engage the hook elements.

Fastening strip 802*a* includes a rib 810 positioned between respective portions of the array of hook elements 806. Rib 810 is provided in the form of a continuous longitudinal protrusion of resin terminating in a rounded convex peak. The rib extends integrally from the fastening surface to an overall height $H_r$ and width $W_r$. Fastening strip 802*b* includes a continuous longitudinal groove 814 positioned between respective portions of loop material 807 so as to align with rib 810 when the fastening strips are brought together for engagement. The groove is formed directly into the flexible base of the fastening strip and provides a concave floor surface which is configured to cooperate with the convex peak of the rib. The groove defines an overall depth $D_g$ and width $W_g$.

As shown in FIG. 8B, the height of the rib and the depth of the groove are such that, when the fastening strips are in the engaged state, the convex outer surface of the rib is forced against the concave floor surface of the groove to provide a sealed engagement. Thus, the rib and groove cooperate to form a non-interlocking barrier to resist fluid flow in the lateral direction. Further, in some examples, the groove can be provided having a greater width than the rib, to allow for some misalignment of the fastening strips without inhibiting the sealing effect at the barrier. In some examples, a more effective sealed engagement can be created when rib 810 is in a compressible, foamed state, such that the rib readily deforms when fastening strips 802*a* and 802*b* are in engaged with one another. As described in U.S. Pat. No. 7,461,437, the entirety of which is hereby incorporated by reference, this type of foamed structure can be formed using appropriate co-extrusion techniques.

Figure 9A:
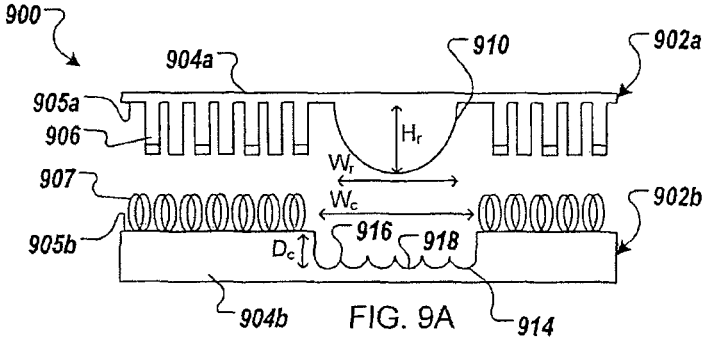
FIGS. 9A and 9B are sequential cross-sectional views of a ninth releasable fastening that illustrate engagement of mating fastening strips.
Figure 9B:
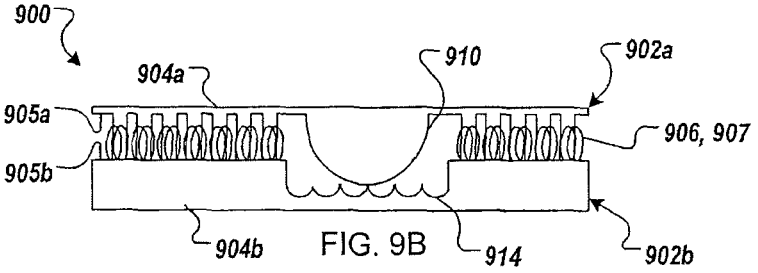

Turning now to FIGS. 9A and 9B, another releasable fastening 900 is shown which is similar to fastening 800. For example, fastening 900 includes two longitudinally continuous fastening strips 902*a* and 902*b* that are intended to releasably engage with one another. Each of fastening strips 902*a* and 902*b* includes an elongated flexible base 904*a*, 904*b* having a fastening surface 905*a*, 905*b* carrying respective components of a hook-and-loop fastening. In particular, fastening surface 905*a* carries an array of discrete hook elements 906, and fastening surface 905*b* carries a patch of loop material 907 configured to engage the hook elements.

As in the previous example, fastening strip 902*a* includes a rib 910 positioned between respective portions of the array of hook elements 906. Again, rib 910 is provided in the form of a continuous longitudinal protrusion of resin terminating in a rounded convex peak. The rib extends integrally from the fastening surface to an overall height $H_r$ and width $W_r$. Fastening strip 902*b* includes a continuous longitudinal channel 914 positioned between respective portions of loop material 907 so as to align with rib 910 when the fastening strips are brought together for engagement. The channel is formed directly into the flexible base of the fastening strip to define an overall depth $D_c$ and width $W_c$. In this example, the floor of channel 914 defines a surface that oscillates between convex surface regions 916 and concave surface regions 918.

FIG. 9B illustrates engagement of fastening strips 902*a* and 902*b*. As shown, the dimensions of the rib and channel are such that, when the fastening strips are in the engaged state, at least one of the convex surface regions encounters the convex peak of the rib. The tension between the engaged fastener elements (i.e., the hook elements and the loop material) balances a compressive force between the peak of the rib and the convex surface region(s) of the channel floor; this interface provides a continuous longitudinal seal. Thus, the rib and channel cooperate to form a non-interlocking barrier to resist fluid flow in the lateral direction. Similar to the previous example, the channel is provided having a greater width than the rib, to allow for some misalignment of the fastening strips without inhibiting the sealing effect at the barrier. In some examples, a more effective sealed engagement can be created when rib 910 is in a compressible, foamed state, such that the rib readily deforms when fastening strips 902*a* and 902*b* are engaged with one another.

Figure 9C:
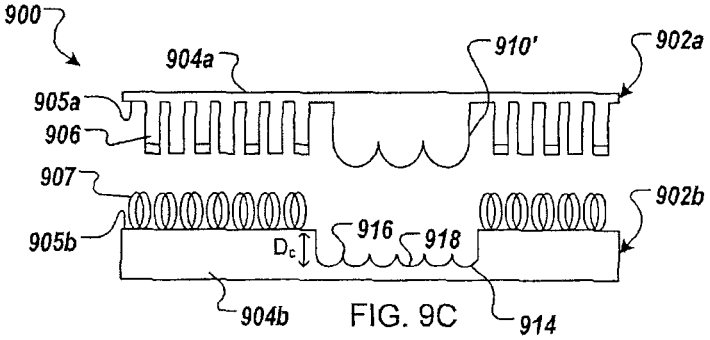
FIG. 9C is a side view of an alternate embodiment of the ninth releasable fastening.

FIG. 9C shows an alternate embodiment of fastening 900 where a multi-rib structure 910' is formed on the fastening strip 902*a*. The multi-rib structure 910' includes multiple parallel ribs with respective convex peaks. The peaks of the multi-rib structure 910' are separated by a distance less than the width $W_c$ of channel 914. In this example, the multi-rib structure includes three ribs. However, more (e.g., four or more) or less (e.g., two) ribs may also be effective. This arrangement provides additional points of contact with the convex surface regions 916, and therefore may provide a more effective seal.

Figure 10A:
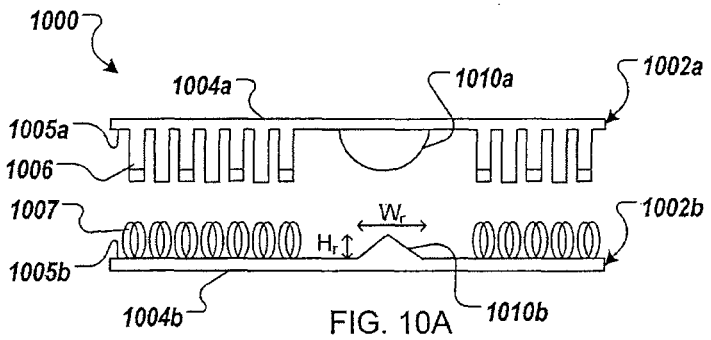
FIGS. 10A and 10B are sequential cross-sectional views of a tenth releasable fastening that illustrate engagement of mating fastening strips.
Figure 10B:
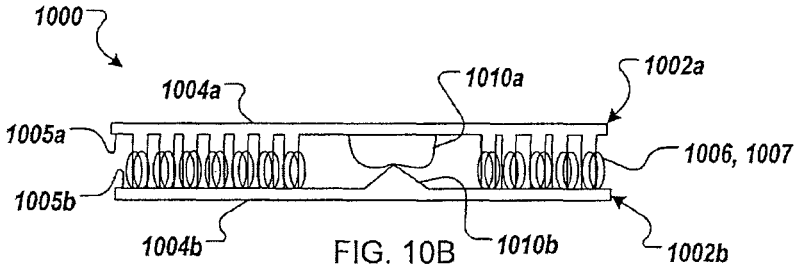

FIGS. 10A and 10B illustrate another releasable fastening 1000. Fastening 1000 includes two longitudinally continuous fastening strips 1002*a* and 1002*b* that are intended to releasably engage with one another. Each of fastening strips 1002*a* and 1002*b* includes an elongated flexible base 1004*a*, 1004*b* having a fastening surface 1005*a*, 1005*b* carrying respective components of a hook-and-loop fastening. In particular, fastening surface 1005*a* carries an array of discrete hook elements 1006, and fastening surface 1005*b* carries a loop material 1007 configured to engage the hook elements.

Fastening strip 1002*a* also includes a rib 1010*a* positioned between portions of the array of hook elements 1006. Rib 1010*a* is provided in the form of a continuous longitudinal bead of highly compliant and/or elastic material applied to fastening surface 1005. For example, rib 1010*a* can be a stable foam or gel construction. Fastening strip 1002*b* also includes a rib 1010*b* positioned between portions of loop material 1007 so as to align with rib 1010*a* when fastening strips 1002*a* and 1002*b* are brought together for engagement. Rib 1010*b* is provided in the form of a continuous longitudinal protrusion of resin having a wedge-shaped structure defining a thick base tapering to a relatively sharp convex peak. The rib extends integrally from the fastening surface to define an overall height $H_r$ and width $W_r$. Rib 1010*b* is considerably more rigid than rib 1010*a*.

When the fastening strips are held together in the engaged state, the longitudinal ribs are pressed against one another. As shown, under pressure the more rigid rib 1010*b* causes the more compliant rib 1010*a* to undergo elastic deformation such that the peak of rib 1010*b* is surrounded by deformed portions of rib 1010*a*. Similar to the previous example, the tension between the engaged fastener elements (i.e., the hook elements and the loop material) balances a compressive force between the compliant rib and the rigid rib; this interface provides a continuous longitudinal seal. In this manner, the ribs cooperate to form a non-interlocking barrier to resist fluid flow in the lateral direction.

Figure 11A:
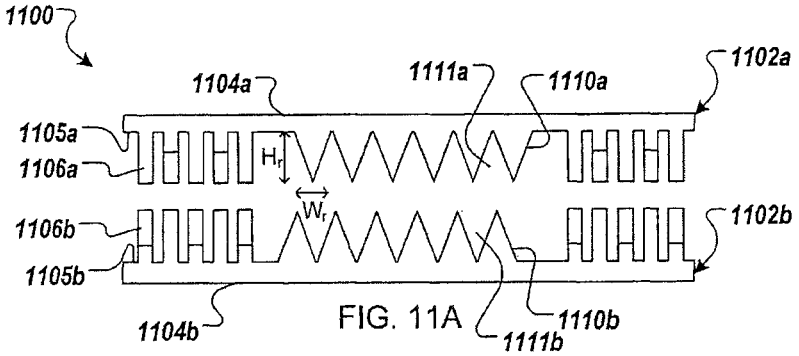
FIGS. 11A and 11B are sequential cross-sectional views of an eleventh releasable fastening that illustrate engagement of mating fastening strips.
Figure 11B:
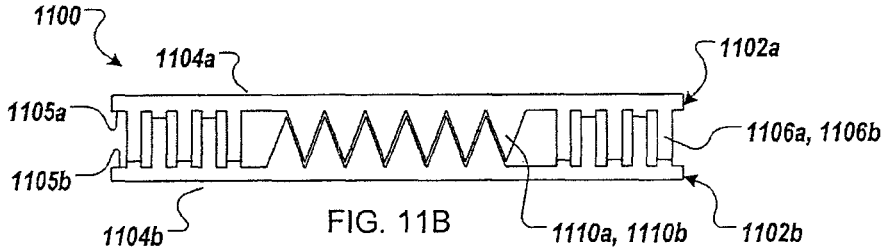

Turning now to FIGS. 11A and 11B, another releasable fastening 1100 is shown. Fastening 1100 includes two longitudinally continuous fastening strips 1102*a* and 1102*b* that are intended to releasably engage with one another in a hook-to-hook engagement. Each of fastening strips 1102*a* and 1102*b* includes an elongated flexible base 1104*a*, 1104*b* carrying an array of discrete fastener elements 1106*a*, 1106*b* on a fastening surface 1105*a*, 1105*b*.

Each of fastening strips 1102*a* and 1102*b* also includes a respective set of ribs 1110*a*, 1110*b* positioned between portions of the arrays of fastener elements 1106*a*, 1106*b*. The sets of ribs are positioned on the fastening surfaces of the strips so as to align with one another when the strips are brought together for engagement. Each of ribs 1110*a* is provided in the form of a continuous longitudinal protrusion of resin having a wedge-shaped structure defining a thick base tapering to a relatively sharp convex peak. The ribs are arranged side by side in the lateral direction such that base of one rib is immediately adjacent to the base of a neighboring rib, forming a trough 1111*a* between the ribs. Each of the ribs extends integrally from the fastening surface to an overall height $H_r$ and width $W_r$. The troughs between adjacent ribs are approximately of the same dimensions. Ribs 1110*b* and troughs 1111*b* are substantially identical to ribs 1110*a* and troughs 1111*a*.

In this example, the ribs extend directly from the fastening surface of the respective fastening strips. Accordingly, the ribs are formed as relatively large structures in order to fill the troughs of the mating rib set to provide an effective sealed engagement (as described below). In some examples, however, the ribs can be supported away from the fastening surface, for example, on a resinous pedestal structure. This allows the ribs to be formed as significantly smaller structures, which can be more easily manufactured.

As shown in FIG. 11B, when the fastening strips are placed in an engaged state, the protruding ribs of one strip are received by the troughs of the other strip to provide a sealed engagement. For example, the meshing ribs can provide a sealed engagement through direct surface contact, or a non-contact labyrinth seal. In any event, the meshing ribs provide a non-interlocking barrier to resist fluid flow in the lateral direction. Further, due to the recurring pattern of the ribs, it may be possible to at least partially misalign the fastening strips without inhibiting the sealing effect at the barrier. In some examples, one of the fastening strips can be provided with fewer ribs than the mating fastening strip. This arrangement can provide some additional open area to manage misalignment of the fastening strips.

Figure 12A:
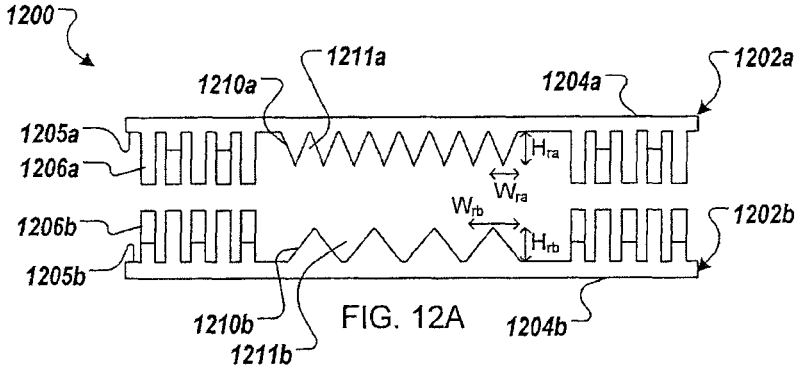
FIGS. 12A and 12B are sequential cross-sectional views of a twelfth releasable fastening that illustrate engagement of mating fastening strips.
Figure 12B:
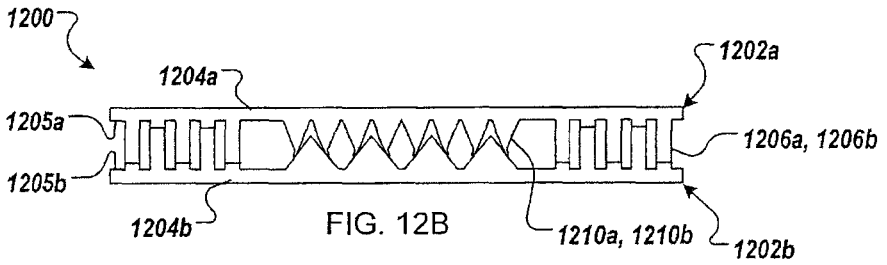

FIGS. 12A and 12B show a releasable fastening 1200 that is similar to fastening 1100. For example, fastening 1200 includes two longitudinally continuous fastening strips 1202*a* and 1202*b* that are intended to releasably engage with one another in a hook-to-hook engagement. Each of fastening strips 1202*a* and 1202*b* includes an elongated flexible base 1204*a*, 1204*b* carrying an array of discrete fastener elements 1206*a*, 1206*b* on a fastening surface 1205*a*, 1205*b*.

Each of fastening strips 1202*a* and 1202*b* also includes a respective set of ribs 1210*a*, 1210*b* positioned between portions of the arrays of fastener elements 1206*a*, 1206*b*. The sets of ribs are positioned on the fastening surfaces of the strips so as to align with one another when the strips are brought together for engagement. Ribs 1210*a* may be similar in structure to ribs 1110*a* from the previous example. For example, each of ribs 1210*a* is provided in the form of a continuous longitudinal protrusion of resin having a wedge-shaped structure defining a thick base tapering to a relatively sharp convex peak. The ribs are arranged side by side in the lateral direction such that base of one rib is immediately adjacent to the base of a neighboring rib, forming a trough 1211*a* between the ribs. Each of ribs 1210*a* extends integrally from the fastening surface to an overall height $H_{ra}$ and width $W_{ra}$. Ribs 1210*b* are similar in structure to ribs 1210*a* in that are continuous in the longitudinal direction and are wedge-shaped. Ribs 1210*b* and troughs 1211*b*, however, are significantly broader than ribs 1210*a* and troughs 1211*a*, extending integrally from the fastening surface to an overall height $H_{rb}$ and width $W_{rb}$ (where $W_{rb}$ is greater than $W_{ra}$).

As shown in FIG. 12B, when the fastening strips are placed in an engaged state, the protruding ribs of one strip are at least partially received by the troughs of the other strip to provide a sealed engagement. In this particular example, there is not a completely meshing of the respective ribs, due to their geometric differences. Instead, the toughs 1211*b*, between the broader ribs 1210*b*, partially receive two of the narrower ribs 1210*a*, while troughs 1211*a* receive just a portion of a single rib 1210*b*. Still, contact between these partially meshing ribs provides a non-interlocking barrier to resist fluid flow in the lateral direction. Further, as shown, the compressive force of engagement between fastening strips 1202*a* and 10202*b* can place ribs 1210*a* in an elastically bent state against ribs 1210*b*. As in the previous example, it may be possible to at least partially misalign the fastening strips without inhibiting the sealing effect at the barrier.

Figure 13A:
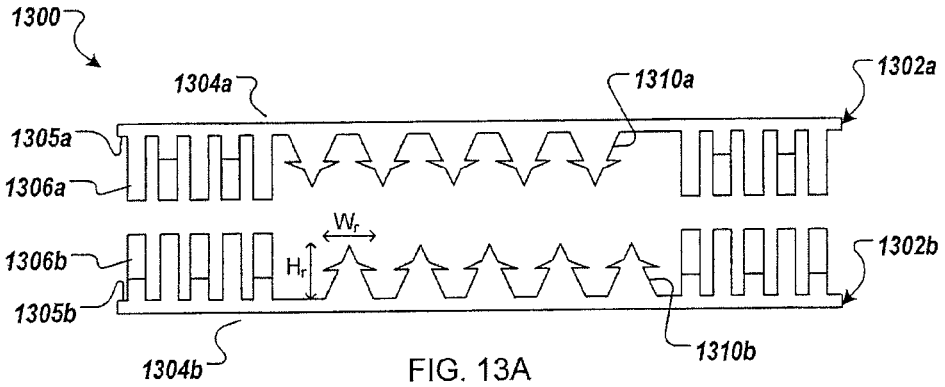
FIGS. 13A and 13C are sequential cross-sectional views of a thirteenth releasable fastening that illustrate engagement of mating fastening strips.
Figure 13B:
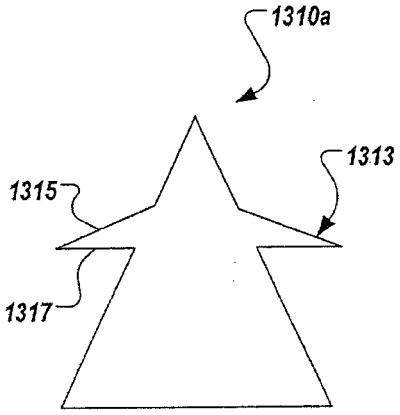
FIG. 13B is an enlarged view of a continuous longitudinal rib provided with sealing tabs.
Figure 13C:
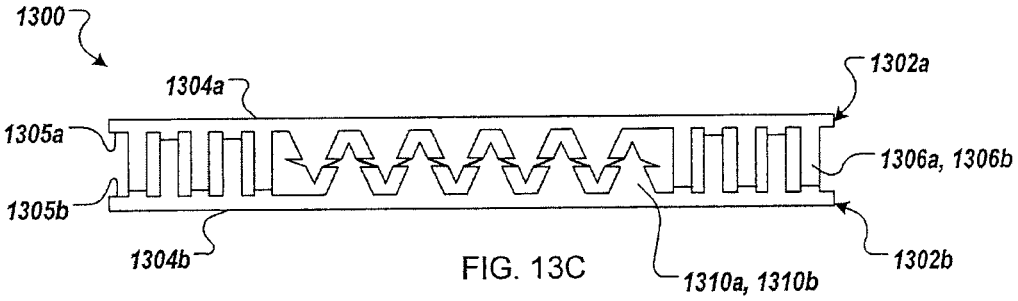

FIGS. 13A-13C show a yet another releasable fastening 1300 that is similar to fastening 1100. For example, fastening 1300 includes two longitudinally continuous fastening strips 1302*a* and 1302*b* that are intended to releasably engage with one another in a hook-to-hook engagement. Each of fastening strips 1302*a* and 1302*b* includes an elongated flexible base 1304*a*, 1304*b* carrying an array of discrete fastener elements 1306*a*, 1306*b* on a fastening surface 1305*a*, 1305*b*.

Each of fastening strips 1302*a* and 1302*b* also includes a respective set of ribs 1310*a*, 1310*b* positioned between portions of the arrays of fastener elements 1306*a*, 1306*b*. The sets of ribs are positioned on the fastening surfaces of the strips so as to align with one another when the strips are brought together for engagement. Similar to some previous examples, each of ribs 1310*a* is provided in the form of a continuous longitudinal protrusion of resin having a wedge-shaped structure defining a thick base tapering to a thin convex peak. In this example, however, ribs 1310*a* also include a pair of sealing tabs 1313 that extend outward in either lateral direction from the main body of the ribs (see FIG. 13B). The sealing tabs are triangularly shaped in lateral cross-section, providing a first sealing face 1315 that is formed at an angle from the fastening surface, and a second sealing face 1317 that is substantially parallel to the fastening surface. Each of the sealing faces extends continuously in the longitudinal direction down the length of the rib. The ribs are arranged parallel to one another and spaced apart in the lateral direction such that there is a region of the fastening surface between neighboring ribs. Each of the ribs extends integrally from the fastening surface to an overall height $H_r$ and width $W_r$. As shown, ribs 1310*b* are substantially identical to ribs 1310*a*.

FIG. 13C illustrates an engagement between fastening strips 1302*a* and 1302*b*. When the fastening strips are placed in an engaged state, the protruding ribs of one strip are at least partially received by the troughs of the other strip to provide a sealed engagement. More specifically, the sealing interface is effected by engagement between the sealing tabs of the respective sets of ribs. For example, as shown, sealing faces 1315 of ribs 1310*a* are pressed against sealing faces 1315 of ribs 1310*b*. Accordingly, the ribs provide a non-interlocking barrier to resist fluid flow in the lateral direction. Further, as in some previous examples, it may be possible to at least partially misalign the fastening strips without inhibiting the sealing effect at the barrier.

Figure 14A:
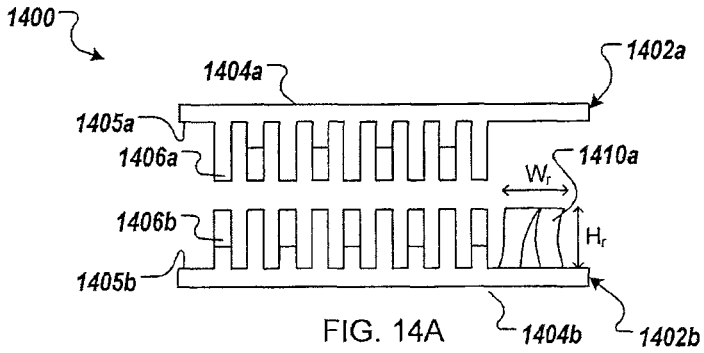
FIGS. 14A and 14B are sequential cross-sectional views of a fourteenth releasable fastening that illustrate engagement of mating fastening strips.
Figure 14B:
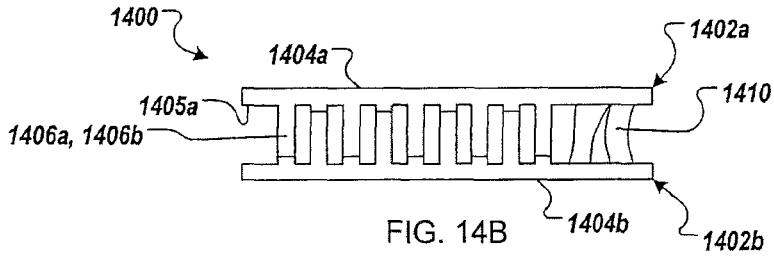

Turning now to FIGS. 14A and 14B, another releasable fastening 1400 is shown.

Similar to some earlier examples, fastening 1400 includes two longitudinally continuous fastening strips 1402*a* and 1402*b* that are intended to releasably engage with one another in a hook-to-hook engagement. Each of fastening strips 1402*a* and 1402*b* includes an elongated flexible base 1404*a*, 1404*b* carrying an array of discrete fastener elements 1406*a*, 1406*b* on a fastening surface 1405*a*, 1405*b*.

Figure 14C:
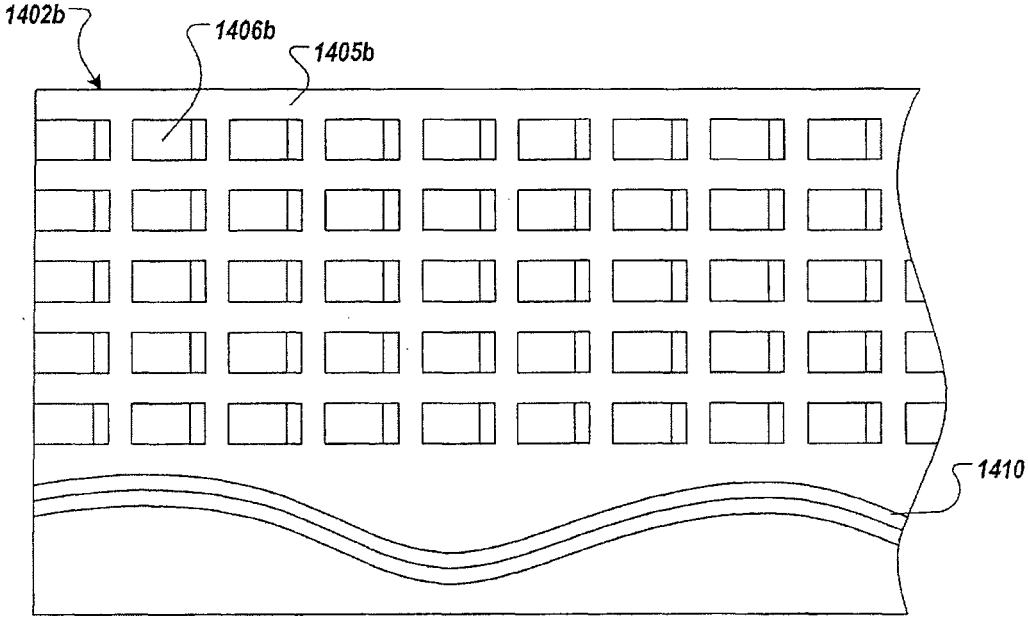
FIG. 14C is a top view of a fastenings strip shown in FIGS. 14A and 14C.

In this example, fastening strip 1402*a* includes an outer tab adjacent the array of fastener elements 1406*a*. The outer tab provides a substantially flat portion of the fastening surface that is devoid of any protuberances. Fastening strip 1402*b* includes an undulating rib 1410 that is continuous in the lateral direction. As shown in FIG. 14C, rib 1410 undulates in widthwise position along the length of fastening surface 1405*a* such that some sections are closer to a lateral edge of fastening strip 1402*a* than other sections. Rib 1410 is positioned on fastening strip 1402*b* so as to align with the tab of fastening strip 1402*a* when the fastening strips are placed in the engaged state. The rib extends from the fastening surface to an overall height $H_r$ and width $W_r$.

As shown in FIG. 14B, the height of rib 1410 is sufficient to cause the peak of the rib to encounter the bare portion of the fastening surface provided by the tab, when the fastening strips are engaged with one another. As such, the rib cooperates with the tab of the other fastening strip to form a non-interlocking barrier 1420 to resist fluid flow. Barrier 1420 provides a seal against fluid flow effected by the interface between rib 1410 and fastening surface 1405*b*.

Figure 15A:
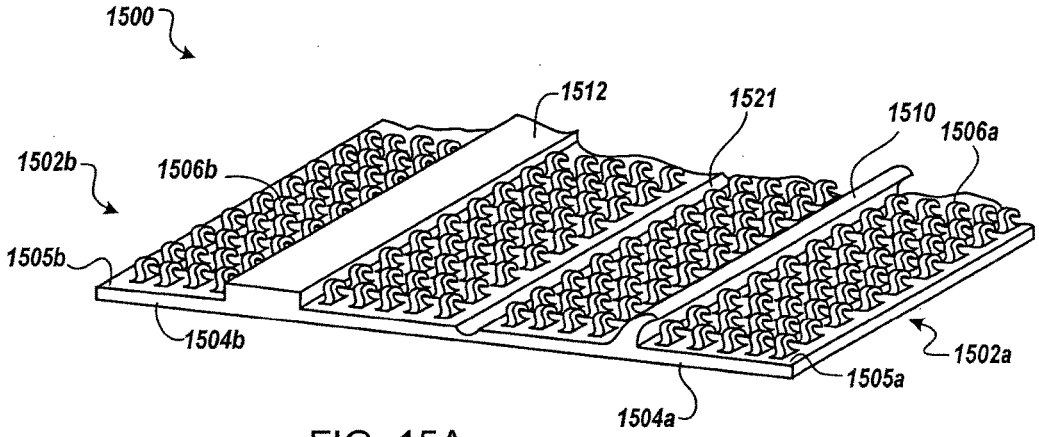
FIGS. 15A and 15B are sequential cross-sectional views of a fifteenth releasable fastening that illustrate engagement of mating fastening strips.
Figure 15B:
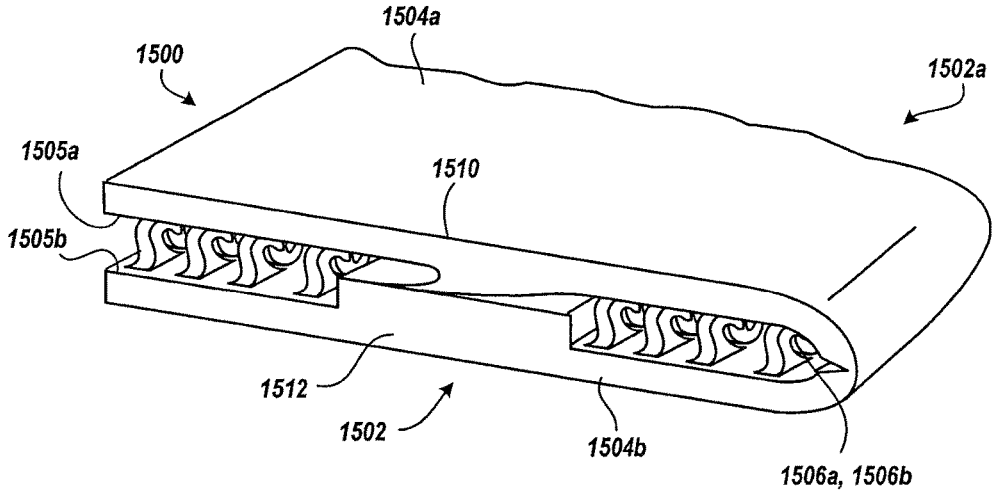

The previous examples have shown various embodiments of a non-interlocking fluid flow barrier formed between cooperating fastening strips. In each of these examples, the fastening strips are shown as entirely separate components. FIGS. 15A and 15B, however, show an example fastening 1500 where the two fastening strips are formed as a unitary mass of resin. Fastening 1500 is similar to fastening 100. For example, fastening 1500 includes two longitudinally continuous fastening strips 1502*a* and 1502*b* that are intended to releasably engage with one another in a hook-to-hook engagement. In this example, fastening strips 1502*a* and 1502*b* share an elongated flexible base 1504 which carries two separate arrays of discrete fastener elements 1506*a*, 1506*b* on a fastening surface 1505. The fastening strips are separated by a molded joint 1521 that extends continuously in the longitudinal direction. Similar to fastening 100, fastening strip 1502*a* includes a longitudinally continuous rib 1510 positioned between two portions of the array of fastener elements 1506*a*. Fastening strip 1502*b* includes a longitudinally continuous pedestal 1512 extending integrally from fastening surface 1505*b*. Pedestal 1512 is formed on fastening surface 1505 between to portions of the array of fastener elements 1506*b* so as to align with the rib when the fastening strips are brought together for engagement. The rib and the pedestal cooperate to form a non-interlocking barrier to resist fluid flow in the lateral direction. As shown in FIG. 15B, the fastening strips are brought together for engagement by folding the flexible base at the longitudinal joint.

Figure 16:
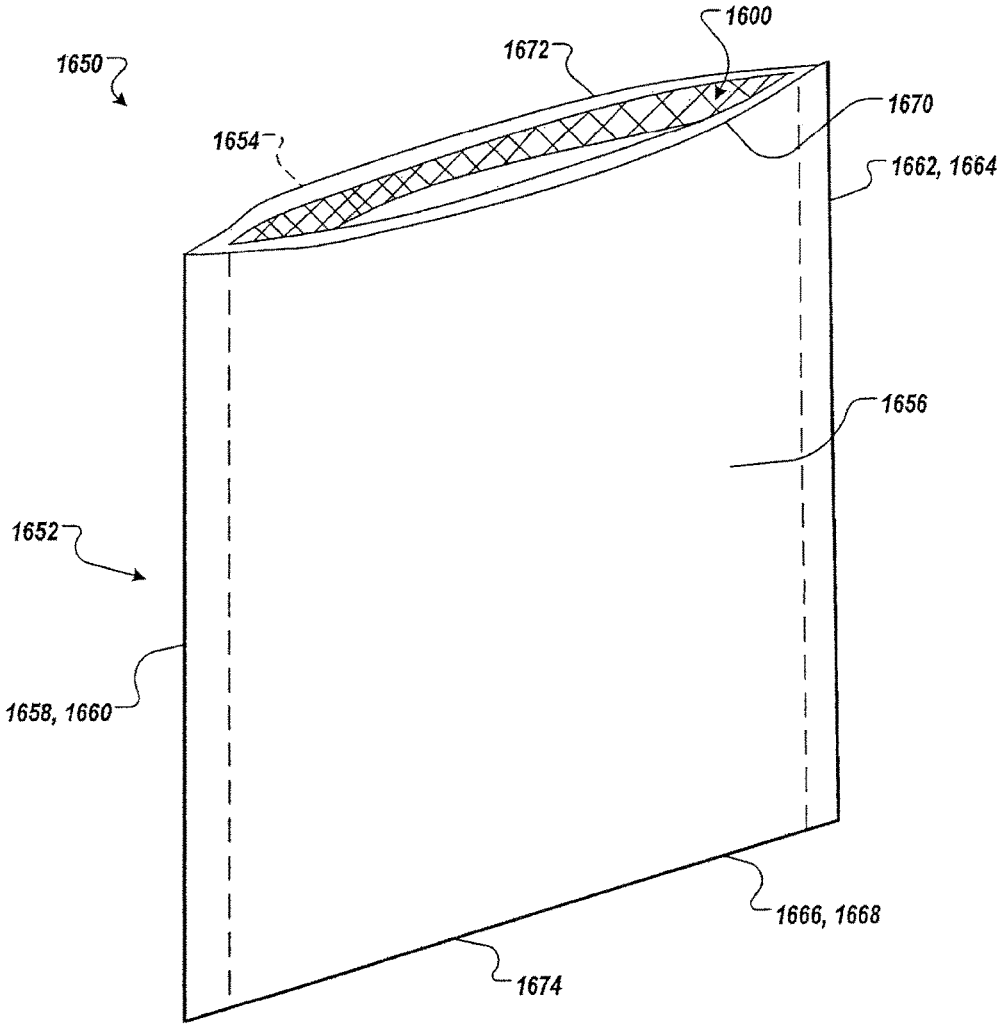
FIG. 16 is a perspective view of a reclosable bag including a releasable fastening in accordance with one or more implementations described herein.

FIG. 16 shows a reclosable bag 1650 that includes a body 1652. Body 1652 includes a first opposing side wall 1654 and a second opposing side wall 1656, each of which has respective first edges 1658, 1660, second edges 1662, 1664, bottom edges 1666, 1668, and top edges 1670, 1672. As shown, top edges 1670, 1672 are not joined together in at least a central portion of side walls 1654, 1656 and bottom edges 1666, 1668 are joined at a fold 1674 in a single sheet of bag film. This configuration results in an open end of bag 1650 opposite to fold 1674. However, any suitable arrangement capable of forming a pouch having an open end may be used. Bag 1650 also includes a releasable fastening 1600 formed on the inner surface of body 1652 proximate top edges 1670, 1672 to facilitate opening and closing of the bag's open end. Releasable fastening 1600 can be formed according to any implementation described herein to serve the dual purpose of securing the bag in a closed position and sealing the pouch area of the bag against fluid flow. In some examples, the releasable fastening can be configured to provide an anti-peel property, in which a portion of the base of the fastening flexes away from the bag body to translate a peel load into a shear load, thereby increasing the initial load required to separate the fastening. Such techniques are described in U.S. Patent Publication 2009/0217492, the entirety of which is hereby incorporated by reference.

Figure 17:
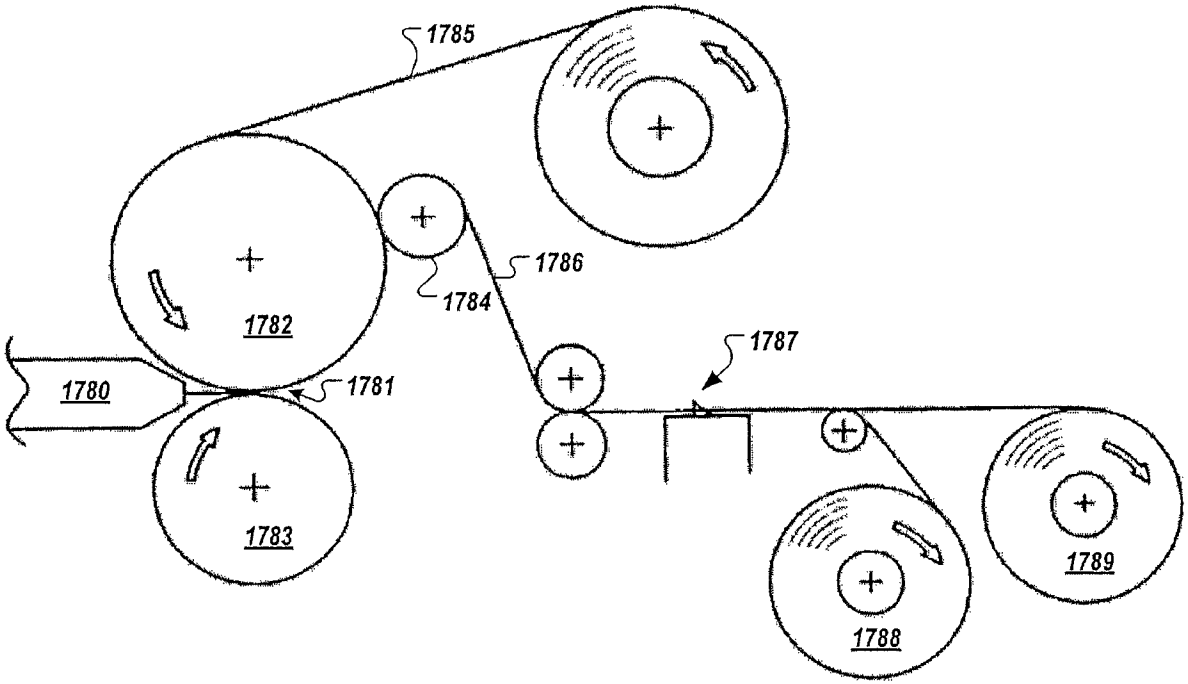
FIG. 17 is a diagram illustrating a fastening strip molding apparatus and method.

FIG. 17 illustrates an example method and apparatus for producing the above-described fastening strips. The method builds upon the continuous extrusion/roll-forming method for molding fastener elements on an integral, sheet-form base described in U.S. Pat. No. 4,794,028, and the nip lamination process described in U.S. Pat. No. 5,260,015, the details of both of which are incorporated herein by reference. The relative position and size of the rolls and other components is not to scale. In this example, an extrusion head 1780 supplies a continuous sheet of molten resin to a nip 1781 between a rotating mold roll 1782 and a counter-rotating pressure roll 1783. Mold roll 1782 contains an array of miniature, fastener element-shaped mold cavities extending inward from its periphery (not shown) for molding the fastener elements. Mold roll 1782 can also include additional mold cavities that are appropriately shaped for forming the sealing features (e.g., the various ribs, spines, etc.) described above. In some examples, spacer rings are provided on the mold roll to form channels on the fastening strips. As described above, the channels can be designed to receive the sealing features to form a non-interlocking barrier against fluid flow.

Pressure in nip 1781 forces resin into the various cavities and forms the fastening strip. The formed product is cooled on the mold roll until the solidified fastener elements (e.g., hooks) and sealing features are stripped from their fixed cavities by a stripper roll 1784. Along with the molten resin, a continuous strip of loop material 1785 can optionally be fed into nip 1781, where it is partially impregnated by resin and becomes permanently bonded to the front face of the substrate. Thus the product 1786 that is stripped from the mold roll includes both fastener elements and loops. For higher production rates, two or more widths of fastening strip may be simultaneously produced on a single mold roll. The multi-width strip can later be split by blade 1787 and spooled on separate product rolls 1788 and 1789. Other variations of the above-described apparatus and method are described in U.S. Pat. No. 6,991,375, the details of which are incorporated herein by reference.

While a number of examples have been described for illustration purposes, the foregoing description is not intended to limit the scope of the invention, which is defined by the scope of the appended claims. There are and will be other examples and modifications within the scope of the following claims. For instance, in some examples, the sealing features (e.g., the ribs, grooves, or other sealing features described herein) can be appropriately designed to compensate for any "backlash" between engaged fastening strips (e.g., the limited freedom or play between engaged fastening strips). Further, in some examples, co-extrusion techniques can be used to form the sealing features from a different material (e.g., a more compliant material) than the fastening strip base or the fastener elements.

What is claimed is:

1. A releasable fastening comprising:

a first fastening strip comprising an elongated, flexible base carrying an array of discrete fastener elements arranged in rows and columns, the array extending across a portion of a width of the base, each of the fastener elements having a resin stem extending from an upper surface of the base, and a lip disposed at a distal end of the stem and overhanging the base; the upper surface of the base and the stems of the fastener elements together forming a contiguous mass of resin; and a second fastening strip configured to releasably engage with the first fastening strip, the second fastening strip comprising a flexible base with an array of discrete fastener elements carried on a fastening side thereof, the array of fastener elements arranged in rows and columns and configured to interlock with the fastener elements of the first fastening strip to releasably hold the first and second fastening strips in an engaged state;

wherein the first fastening strip also comprises a longitudinally continuous rib that extends from the base of the first fastening strip and has a longitudinally continuous, convex outer surface; and wherein the second fastening strip has a projection extending from the base of the second fastening strip to a longitudinally continuous peak having a greater degree of curvature than the convex outer surface of the rib of the first fastening strip, the peak of the projection arranged to engage the convex outer surface of the rib in the engaged state, such that tension between the fastener elements of the first and second fastening strips balances a compressive force between the peak and convex outer surface in the engaged state, thereby forming a non-interlocking barrier to resist flow across the fastening with the first and second fastening strips in the engaged state.

2. The fastening of claim 1, wherein the longitudinally continuous rib of the first fastening strip is a first rib, and wherein the first fastening strip further comprises a second rib having a second convex outer surface, the second rib extending longitudinally parallel to the first rib.

3. The fastening of claim 1, wherein the rib of the first fastening strip comprises a compressible material.

4. The fastening of claim 1, wherein the rib of the first fastening strip is integrally formed with the base and the discrete fastener elements as part of the contiguous mass of resin.

5. The fastening of claim 1, wherein the longitudinally continuous peak of the projection of the second fastening strip is formed between two convex surfaces of the base of the second fastening strip.

6. A releasable fastening comprising:

first and second fastening strips, each comprising an elongated and flexible base carrying a field of fastener elements on a planar fastening region extending across a portion of a width of the base, the field of fastener elements of the second fastening strip configured to engage the field of fastener elements of the first fastening strip to releasably hold the first and second fastening strips in an engaged state, the field of fastener elements of the first fastening strip comprising an array of discrete fastener elements arranged in rows and columns, each of the fastener elements having a resin stem extending from an upper surface of the base within the fastening region, and a lip disposed at a distal end of the stem and overhanging the base, the upper surface of the base and the stems of the fastener elements together forming a contiguous mass of molded resin, wherein the first fastening strip further comprises a longitudinally continuous rib residing adjacent the fastening region and extending to an overall height from the base and having a longitudinally continuous, convex outer surface;

wherein the second fastening strip further comprises a longitudinally extending sealing region residing adjacent the fastening region, the sealing region comprising a channel extending into the base to an overall depth and having a non-planar channel floor; and wherein the overall height of the rib and the depth and shape of the channel are selected to cause the floor of the channel of the second fastening strip to engage the rib of the first fastening strip when the first and second fastening strips are in the engaged state, such that tension between the respective fastener elements balances a compressive force between the rib and the channel floor, thereby forming a non-interlocking barrier to resist flow across the engaged first and second fastening strips.

7. The fastening of claim 6, wherein the longitudinally continuous rib of the first fastening strip is a first rib, and wherein the first fastening strip further comprises a second rib having a second convex outer surface, the second rib extending longitudinally parallel to the first rib and arranged to engage the channel floor of the second fastening strip.

8. The fastening of claim 6, wherein the rib of the first fastening strip comprises a compressible material carried on the base of the first fastening strip.

9. The fastening of claim 6, wherein the width of the channel floor of the second fastening strip is greater than the width of the rib of the first fastening strip.

10. The fastening of claim 6, wherein the height of the rib of the first fastening strip is greater than a height of the fastener elements of the first fastening strip.

11. The fastening of claim 6, wherein the rib of the first fastening strip is integrally formed with the base and the discrete fastener elements as part of the contiguous mass of molded resin.

12. The fastening of claim 6, wherein the lip of each of the fastener elements of the first fastening strip overhangs the base in a longitudinal direction of the base.

13. The fastening of claim 6, wherein the field of fastener elements of the second fastening strip comprises a second array of discrete fastener elements arranged in rows and columns and configured to interlock with the fastener elements of the first fastening strip.

14. The fastening of claim 6, wherein the non-planar floor of the channel comprises multiple parallel longitudinally continuous peaks extending to engage the outer surface of the rib of the first fastening strip when the first and second fastening strips are in the engaged state.

15. The fastening of claim 6, wherein the non-planar floor of the channel comprises a longitudinally continuous, concave surface having a greater width than the rib of the first fastening strip.

* * * * *